United States Patent [19]

Woodier et al.

[11] 4,060,352

[45] Nov. 29, 1977

[54] SEALING GRID SYSTEM FOR ROTARY PISTON MECHANISM OF THE WANKEL TYPE

[75] Inventors: George H. Woodier, Ringwood; Robert E. Mount, Mendham, both of N.J.

[73] Assignee: Curtiss-Wright Corporation, Wood-Ridge, N.J.

[21] Appl. No.: 732,412

[22] Filed: Oct. 14, 1976

[51] Int. Cl.[2] ..... F01C 19/04; F01C 19/08; F04C 27/00

[52] U.S. Cl. ..... 418/122; 418/142; 418/143

[58] Field of Search ..... 418/51, 113, 120–124, 418/142, 143; 277/81 P

[56] References Cited

U.S. PATENT DOCUMENTS

| | | | |
|---|---|---|---|
| 705,835 | 7/1902 | Grove | 418/142 |
| 3,064,880 | 11/1962 | Wankel et al. | 418/142 |
| 3,081,745 | 3/1963 | Hurley | 418/142 |
| 3,139,233 | 6/1964 | Simonsen | 418/142 |
| 3,205,872 | 9/1965 | Pomasanow | 418/121 |
| 3,506,275 | 4/1970 | Moriyama | 418/142 |
| 3,768,936 | 10/1973 | McCormick | 418/142 |
| 3,814,556 | 6/1974 | Wilmers et al. | 418/142 |

FOREIGN PATENT DOCUMENTS

| | | | |
|---|---|---|---|
| 1,175,941 | 8/1964 | Germany | 418/142 |
| 2,259,324 | 6/1974 | Germany | 418/142 |

*Primary Examiner*—John J. Vrablik

*Attorney, Agent, or Firm*—Arthur Frederick; Victor D. Behn

[57] ABSTRACT

The sealing grid system for a rotary piston mechanism of the Wankel type comprises apex seal assemblies and a plurality of seal strips slidably disposed in recesses in at least one face of the rotary piston. Each of the recesses are formed at the juncture of the peripheral surface of the rotary piston and the surface of one of the rotary piston faces and extend to communicate with next adjacent apex seal slots. A groove is formed in the bottom of each of the recesses to receive a biasing member, V-shaped in cross-section, which functions to both urge the associated seal strip outwardly of the recess and to seal the interstices between the seal strip and its recess. Each of the seal strips is dimensioned in length to abut the next adjacent apex seal blades.

5 Claims, 5 Drawing Figures

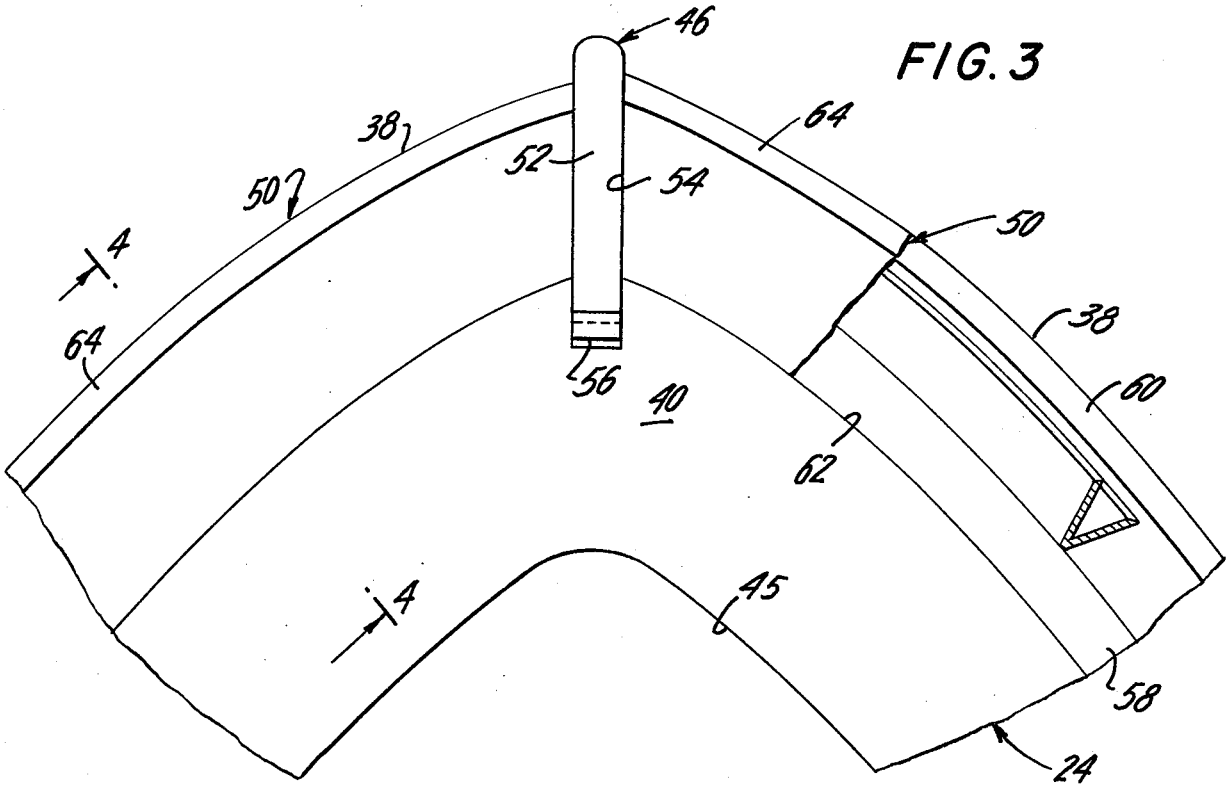
FIG. 3
FIG. 4
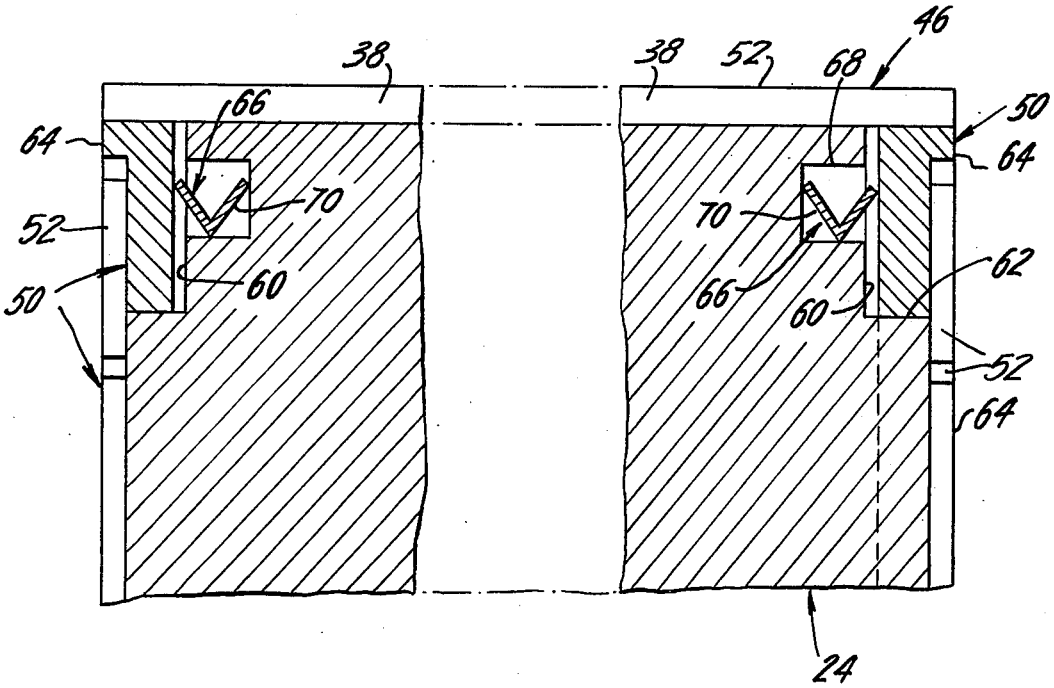

SEALING GRID SYSTEM FOR ROTARY PISTON MECHANISM OF THE WANKEL TYPE

This invention relates to sealing grip systems for rotary piston mechanisms of the Wankel type disclosed in U.S. Pat. to Wankel, et al, No. 2,988,065 dated June 13, 1961, and more specifically to side gas seals.

BACKGROUND OF THE INVENTION

One of the critical problems in the design of Wankel-type rotary piston mechanisms is to provide an efficient sealing grid system whereby the working chambers are substantially completely isolated from each other. The most successful sealing grid systems, to date, have been those employing apex seal pins sealingly interconnecting the apex seal blade with the ends of side gas seal strips as exemplified in the Wankel et al U.S. Pat. No. 3,064,880 dated Nov. 20, 1962 and the U.S. Pat. to Fisch, Nos. 3,134, 600 dated May 26, 1964; Bentele, 3,180,562 dated Apr. 27, 1965; Jones, 3,400,691 dated Sept. 10, 1968; and Larrinaga et al, 3,674.384 dated July 4, 1972. While these sealing grid systems are practical and effective, they are relatively expensive and in small engine applications, as for example, lawnmowers, chainsaws and the like, may reduce the competitive advantages over conventional small reciprocating piston engines. One reason for the costliness of such sealing grid systems is the expense of accurately machining the seal pin holes, the slots in the seal pins to match the slots in the rotor apex, and the steps in the pins so as to properly receive, in abutment, the gas seal strips. Also, such a relatively complex sealing grid system represents costly assembly procedures. Obviously, a simplified sealing grid system, which eliminates the necessity for apex seal pins, would materially reduce the cost of an engine and render it more competitive with the conventional reciprocating piston engines.

Accordingly, it is an object of this invention to provide a sealing grid system for a Wankel-type engine which is relatively simple, inexpensive and obviates the necessity for apex seal pins.

It is another object of the present invention to provide a sealing grid system for a Wankel-type engine which is sufficiently effective to be suitable for small sized engines where efficiency is of secondary concern.

SUMMARY OF THE INVENTION

The invention therefore contemplates, in a rotary mechanism of the Wankel type, a sealing grid system which is simple and inexpensive and relatively effective.

A rotary mechanism of the Wankel type basically comprises two end walls separated by a peripheral wall of trochoidal shape and defining a housing cavity of multi-lobe configuration and in which a rotor is supported eccentrically for planetary movement relative to the end and peripheral walls. The rotor has a multi-sided profile and two opposite side faces and a plurality of peripheral surfaces or flank portions intersecting each other to form apex portions. The rotor and housing cavity define therebetween a plurality of working chambers which successively expand and contract in volumetric size as the rotor planetates within the cavity. To substantially isolate the working chambers from each other, a sealing grid system, according to this invention, is provided.

The sealing grid system comprises apex seal means, including blade means, at each apex portion of the rotor to engage the inner surface of the peripheral wall and the inner surfaces of the end walls. The system also includes a side seal assembly carried in at least one rotor face.

The side seal assembly comprises a plurality of recesses in said one side face of the rotor. Each of the recesses extends along the juncture of the side face and a peripheral surface of the rotor. A seal member is disposed for slidable movement within each recess. Each of the seal members is dimensioned to extend between and in sealing relation with the next adjacent apex blade. Each seal member has a wear surface for engaging the inner surface of the adjacent housing end wall. A groove is formed in each of the recesses. A biasing member, having two resilient leg portions, is disposed in each groove to bias the associated seal member in a direction outwardly of the recess and its wear surface in contact with the adjacent housing end wall and simultaneously effecting a seal of the space between the recess and its associated seal members. The biasing member is so constructed and arranged in its associated groove that gas leakage is trapped between its leg portions so that the pressure exerted by such gas leakage exerts a force on the leg portions to insure constant and continuous sealing engagement.

BRIEF DESCRIPTION OF THE DRAWINGS

The invention will be more fully understood from the following description when considered in connection with the accompanying drawings in which:

FIG. 3 is an enlarged fragmentary view of the rotary piston or rotor of the mechanism of FIG. 1 with parts broken away for illustration purposes, showing part of the sealing grid, according to the present invention;

FIG. 4 is a cross-sectional view taken along line 4—4 of FIG. 3; and

DESCRIPTION OF THE PREFERRED EMBODIMENT OF THE INVENTION

Figure 1:
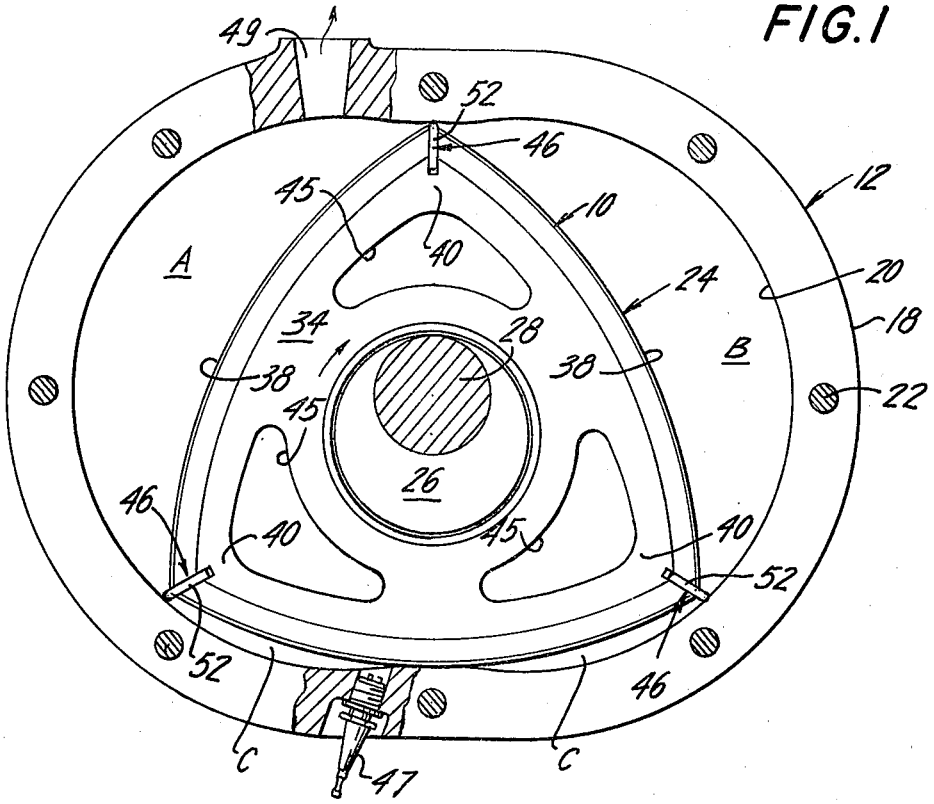
FIG. 1 is a cross-sectional view of a Wankel-type rotary piston mechanism taken substantially along line 1—1 of FIG. 2 and which is provided with a sealing grid, according to this invention.
Figure 2:
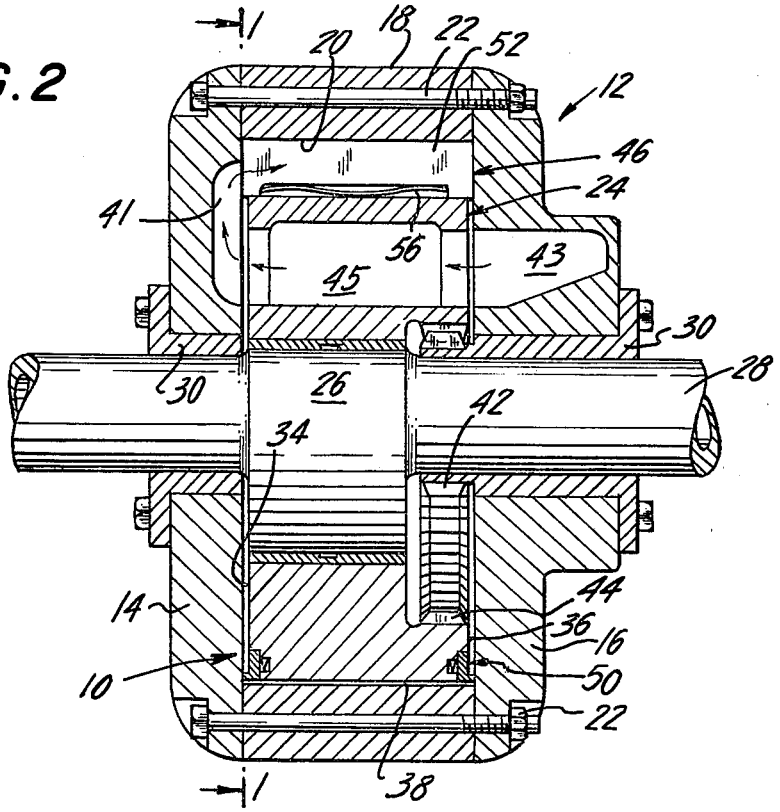
FIG. 2 is a transverse cross-sectional view of the mechanism shown in FIG. 1.

Now, referring to the drawing and, more specifically, FIGS. 1 and 2, the reference number 10 generally refers to the sealing grid, according to the present invention, for a rotary piston mechanism 12 of the Wankel type. For descriptive purposes only, mechanism 12 is shown and will be described as a charge-cooled-rotor, rotary internal combustion engine. It is, of course, to be understood that sealing grid 10 has application to a broad range of Wankel-type mechanisms such as expanders, pumps and compressors, without departure from the scope and spirit of the invention.

The mechanism 12 comprises two end walls 14 and 16 spaced in substantial parallelism by a peripheral wall 18 against which the end walls abut. The peripheral wall 18 has a trochoidal shaped inner surface 20. The end walls 14 and 16, and peripheral wall 18 are held together by a plurality of tie-bolts 22 to thereby define therebetween a two-lobe housing cavity. A rotary piston or rotor 24 of generally triangular shape is supported in the housing cavity by an eccentric portion 26 of a mainshaft 28. The mainshaft is supported for rotation in bearings 30 disposed in end walls 14 and 16 while rotor 24 is supported via a sleeve bearing 32 on eccentric portion 26 of the mainshaft. The rotor 24 has two opposite side faces 34 and 36 and three peripheral surfaces or flanks 38 which intersect each other to form three apex portions 40. The rotor 24 defines with the housing walls 14, 16 and 18, a plurality of working chambers A, B and C which successively expand and contract in volumetric size as the rotor planetates within the housing cavity. To maintain rotor 24 in the desired angular relationship to the housing as it planetates within the housing cavity, timing gears 42 and 44 are provided. The gear 42 is a pinion gear secured against rotation by attachment to end wall 16 while gear 44 is an internal ring gear secured to or forming part of rotor 24, and which is in mesh with pinion gear 42. The mechanism 12, as shown, has suitable porting 41 and 43 in end walls 14 and 16, respectively, and passages 45 extending axially through rotor 24 to alternately pass a fuel-air mixture into working chambers A, B and C when each is at the intake phase of operation. A spark plug 47 is secured in peripheral wall 18 to ignite the fuel-air mixture after compression and an exhaust port 49 is provided to pass spent combustion products from the working chambers. To isolate working chambers A, B, and C from each other and surrounding spaces, sealing grid 10 of this invention is incorporated in mechanism 10.

The sealing grid 10 comprises essentially an apex seal assembly 46 at each of the apex portions 40 which coact with a plurality of side gas seal members 50 carried in both of the rotor faces 34 and 36, as shown, or in one of the faces if less efficiency is acceptable.

Each of the apex seal assemblies 46 may consist of, as bestshown in FIGS. 3 and 5, a single-piece blade 52 slidably receivable in a radially extending groove or slot 54 in an apex portion 40 of rotor 24 and biased radially outwardly by a leaf spring 56 or may comprise, without departure from the scope and spirit of this invention, a different construction such as exemplified in the following U.S. patents:

| | | |
|---|---|---|
| Anderson | No. 3,102,518 | 9/ 3/63 |
| Jones | No. 3,300,124 | 1/24/67 |
| Jones | No. 3,400,691 | 9/10/68 |

Figure 5:
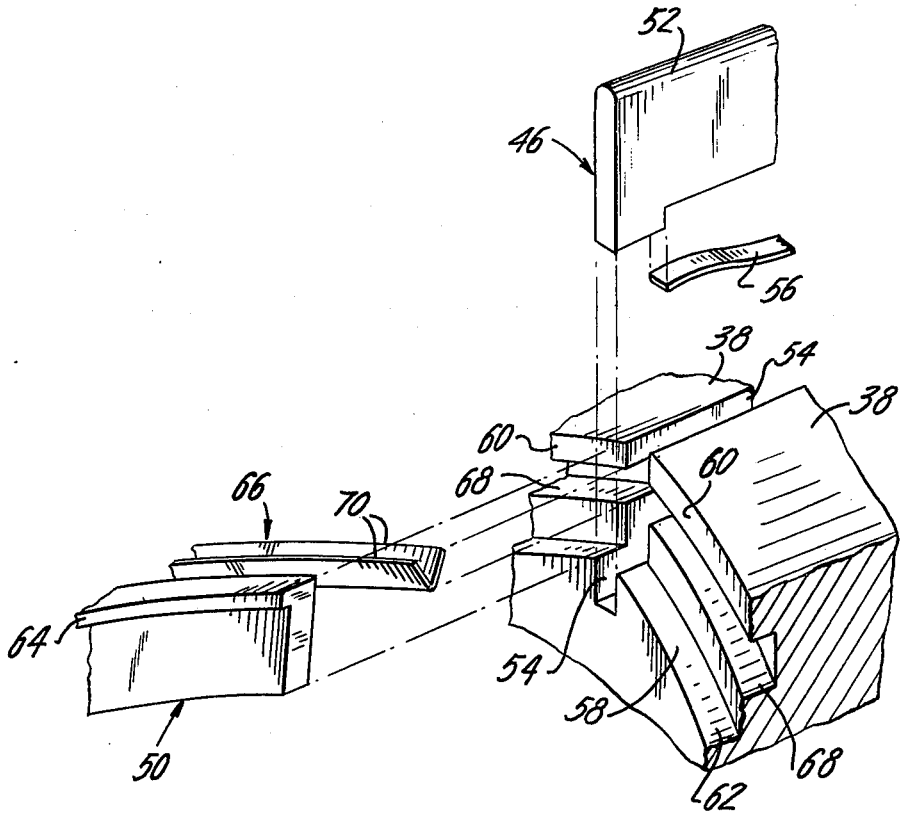
FIG. 5 is a fragmentary, exploded view in perspective of the sealing grid, according to this invention.

Each of the gas seal members 50 comprise, as best illustrated in FIGS. 3 to 5, an elongated strip, rectangular in cross-section, and having a configuration substantially complementary to that of rotor flank portions 38. Each strip 50 is disposed in a recess 58 in the rotor face 34 or 36 which is located at the juncture of such face with a flank portion 38 and extending to communicate with next adjacent apex seal grooves 54. Each recess 58 has a bottom surface or wall 60 and an intersecting surface or wall 62. Each strip 50 is of a length to extend between and, at proper operating temperatures, abut at its opposite ends, apex seal blades 52. To insure sealing contact of each strip 50 with the adjacent inner surfaces of end walls 14 and 16, each strip 50 has a projection or protuberance 64 which provides a contact or wear surface. For biasing each seal strip 50 outwardly of its associated recess 58, a biasing member 66, in the form of an elongated metal element of spring steel and of V-shaped cross-section, is disposed in a groove 68 formed in the bottom surface 60 of the associated recess 58. The groove 68, as shown, extends to communicate with next adjacent apex seal slots 54 although this is not essential. Each of the biasing members 66 is substantially the length of its associated groove 68 and is positioned wit the distal end portions of its legs 70 engaging the bottom wall of groove 68 and the inner surface (surface opposite protuberance 64) of seal strip 50. The contact of the distal end portions of legs 70 of each biasing member 66 with the bottom of groove 68 and associated seal strip 50, effects a fluid seal which prevents gases, from working chambers A, B and C, by-passing, in a radial direction, seal strip 50. Thus, each of the biasing members 66 is confined in a groove 68 which facilitates assembly, and also prevents its unintentional dislodgement. In addition, biasing members 66 function not only to resiliently urge seal strips 50 into engagement with the adjacent inner surfaces of end walls 14 and 16, but function to seal the interstices between the seal strips 50 and recesses 58. To supplement the biasing force exerted by the inherent resiliency of each of the biasing members 66, the biasing member 66 is so positioned that gas leakage is trapped in the space between legs 70 to thereby exert a pressure on legs 70 in a direction to urge them into contact with the bottom wall of the associated groove 68 and the associated seal strip 50. Thus, the trapped leakage gas pressure assures constant and continuous sealing contact of the biasing members 66 at the distal ends of their legs 70.

It is believed now readily apparent that the present invention provides for a Wankel rotary mechanism, a relatively effective and inexpensive sealing grid which eliminates the need for apex seal pins and oil seals and, therefore, is particularly well suited to small rotary mechanisms where high efficiency is not essential.

Although but one embodiment of this invention has been illustrated and described in detail, it is to be expressly understood that the invention is not limited thereto. Various changes can be made in the arrangement of parts without departing from the spirit and scope of the invention as set forth in the appended claims and as the same will now be understood by those skilled in the art.

What is claimed is:

1. In a rotary mechanism comprising a rotor having opposite side faces and peripheral surfaces intersecting each other to form apex portions and which rotor is supported for rotation within a cavity formed by a peripheral wall and opposite end walls of a housing, an apex seal means, including blade means at each apex portion to engage said peripheral wall, side seal assembly carried in at least one side face of the rotor for sealing the interstices between the one side face and the adjacent end wall of the housing and substantially isolating the working chambers formed by the rotor and said cavity, the side seal assembly comprises:

a. a plurality of recesses in said one side face of the rotor;

b. each recess extending in said one side face and along the juncture of the one side face and a peripheral surface between next adjacent apex seal means;

c. a seal member slidably receivable in each of the recesses and dimensioned to extend between and in sealing abutting relation with next adjacent apex blade means;

d. each seal member having a wear surface for engaging the adjacent housing end wall;

e. a groove in each of said recesses; and f. a biasing member having two resilient leg portions disposed in each groove to bias the associated seal member in a direction outwardly of the recess and its wear surface in contact with the adjacent housing end wall and simultaneously effecting a seal of the space between the recess and its associated seal member.

2. The apparatus of claim 1 wherein the biasing member is V-shaped in cross-section.

3. The apparatus of claim 2 wherein the distal ends of the leg portions of the V-shaped biasing member continuously sealingly engage the associated seal member and the bottom of the associated groove.

4. The apparatus of claim 2 wherein each of the grooves are dimensioned to receive substantially the entire associated V-shaped biasing member.

5. The apparatus of claim 2 wherein the seal member is an elongated member substantially rectangular in cross-section and having a wear surface for engaging the adjacent housing end wall.

* * * * *